US005194846A

United States Patent [19]

Lee et al.

[11] Patent Number: 5,194,846

[45] Date of Patent: Mar. 16, 1993

[54] COMMUNICATION SYSTEM CAPABLE OF BROADCAST MESSAGING AND TRANSPONDER POLLING

[75] Inventors: Tim Lee, Owen Sound; Don Becker, Tara; Cathy Robins; Leo Mullins, both of Owen Sound; Bill Oliver, Tara; Mike Slack, Owen Sound, all of Canada

[73] Assignee: General Signal Corporation, Stamford, Conn.

[21] Appl. No.: 696,497

[22] Filed: May 7, 1991

[51] Int. Cl.[5] ..... G08G 26/00

[52] U.S. Cl. ..... 340/505; 340/518; 340/825.06; 340/825.08; 340/825.54

[58] Field of Search ..... 340/505, 502, 501, 518, 340/825.07, 825.08, 825.09, 825.10, 825.11, 825.12, 825.13, 825.54

[56] References Cited

U.S. PATENT DOCUMENTS 4,507,652 3/1985 Vogt et al. ..... 340/501
4,614,945 9/1986 Brunius et al. ..... 340/505
4,742,335 5/1988 Vogt ..... 340/518

*Primary Examiner*—Jin F. Ng
*Assistant Examiner*—Edward Lefkowitz
*Attorney, Agent, or Firm*—Robert R. Hubbard; John F. Ohlandt

[57] ABSTRACT

A communication system in which a controller is coupled over a communication path with two or more transponders, at least two of which transponders have different addresses, which controller and transponders communicate by periodically transmitting a broadcast message simultaneously to all transponders, transmitting an acknowledge message indicative of a new input received by at least one of the transponders, and individually polling all of the transponders using a polling technique which incorporates time periods to allow communication between the controller and a selected transponder, wherein the polling is only activated subsequent to the transmission of the acknowledge message. Periodic polls of all transponders in sequence provide supervision of the integrity of the system.

8 Claims, 5 Drawing Sheets

COMMUNICATION SYSTEM CAPABLE OF BROADCAST MESSAGING AND TRANSPONDER POLLING

The present invention relates to a communication system of an alarm of an life safety system in which a controller communicates with two or more transponders, which transponders have different addresses. This unique system is an energy efficient and time saving system wherein continuous individual polling of the transponders is avoided without jeopardizing the primary function of the system. This is accomplished by having a communication system which periodically broadcasts a general message to all transponders to determine whether any of the transponders has received a new input (alarm signal). Thereafter, it will individually poll each of the transponders only if at least one of the transponders has acknowledged the broadcast message.

BACKGROUND OF THE INVENTION

There are numerous polling techniques currently being used to communicate between controllers and transponders. One such system has been developed in which the individual transponder units all have their individual respective addresses, which differ from each other, and the various alarm or transponder units can reply to the controller when addressed. In this way the controller knows when a transponder has a defect or trouble condition when it does not reply to a normal inquiry, even when no alarm or danger condition is present adjacent the addressed transponder.

In such polling arrangements, the transponders are frequently addressed in sequence. For example, if there are 60 transponders connected over a single communication path to a controller, the first transponder is addressed and given time to reply, the second is then addressed, and so forth through the entire 60 units. In this way the controller is continually checking on the operability as well as the alarm status of each of the units.

The aforementioned polling techniques have the following disadvantages. Should an alarm or new input be received by one or more transponder of the system, these polling arrangements require that the system continue interrogating each unit of the system, reset and then interrogate the system again in order to detect that one of the units has received a new input. Although this time period may only be a few seconds, such seconds are precious during most alarm and life safety crises.

One attempt at overriding the normal polling sequence when a high priority message is initiated at a given transponder is set forth in U.S. Pat. No. 4,742,335 (Vogt), which issued on May 3, 1988. This communication system provides a means to define at least one time segment, which occurs at a predetermined time in a polling routine. The time segment may occur at or within the address time of a given transponder, or at a time interval between the addresses or response times of two transponders, or at a time after all the transponders have been addressed and given an opportunity to reply before the next round of polling. During the predefined time segment one or more transponders, from one or more specified groups, can simultaneously reply to the controller regardless of whether the transponders simultaneously have been specifically addressed by the controller. That is, a "public time" is provided to allow nearly instantaneous identification and verification of a high priority interrupt (such as a holdup alarm). However, such "public time" is alloted repetitively on a fixed time basis regardless of whether it is called for due to exigencies of the moment.

The present inventors believe that the above-referenced conventional polling arrangements are, in general, extremely inefficient. Those arrangements require continuous and repetitive polling of each individual transponder, thereby wasting energy that may be in short supply, especially in battery operated systems. Therefore, the present inventors have developed a unique communication system which conserves energy, and which is capable of rapid detection and polling of transponders receiving new inputs.

The present invention also provides many additional advantages which shall becomes apparent as described below.

SUMMARY OF THE INVENTION

A communication system in which a controller, which provides timing, is coupled over a communication path with two or more transponders, at least two of which transponders have different addresses, said system comprising: means for periodically transmitting a broadcast message simultaneously to all of said transponders; means for transmitting an acknowledge message, responsive to receopt of said broadcast message, from one of said transponders to said controller responsive to a new input existing at said one of said transponders; means for polling said transponders by sequentially transmitting signals corresponding to their individual addresses using a polling technique which incorporates time periods to allow communication between the controller and a selected transponder, wherein said means for polling is activated to poll all of the transponders only if at least said one of the transponders has acknowledged the broadcast message by transmitting an acknowledge message to said controller; and means for polling high priority transponders first by starting the polling at address zero, said high priority transponders having addresses, which are the lowest of addresses assigned to transponders.

The communication system may also include a means for latching a new input, a means for enabling a new input, a means for disabling a new input, a means for triggering a new input flag, a means for resetting a new input flag, and a means for resetting the timing of the controller or driver.

A further object of the present invention is to provide a method of polling a plurality of individually addressable transponders to effect bidirectional data transmission which comprises the steps of: (a) regularly transmitting a broadcast message to all transponders simultaneously, in which any transponder may communicate with the controller responsive to the broadcast message by transmitting an acknowledge message to indicate that it has received a new input; and (b) individually polling the transponders to effect usual data transmission upon the controller receiving the acknowledge message, in which each successive transponder communicates with the controller during a predetermined time period.

This method according to the present invention may also include the following additional steps: latching a new input; enabling and/or disabling a new input; triggering a new input flag; resetting a new input flag; and resetting the timing of the controller.

Other and further objects, advantages and features of the present invention will be understood by reference to the following specification in conjunction with the annexed drawings, wherein like parts have been given like numbers.

DESCRIPTION OF THE PREFERRED EMBODIMENTS

Figure 5:
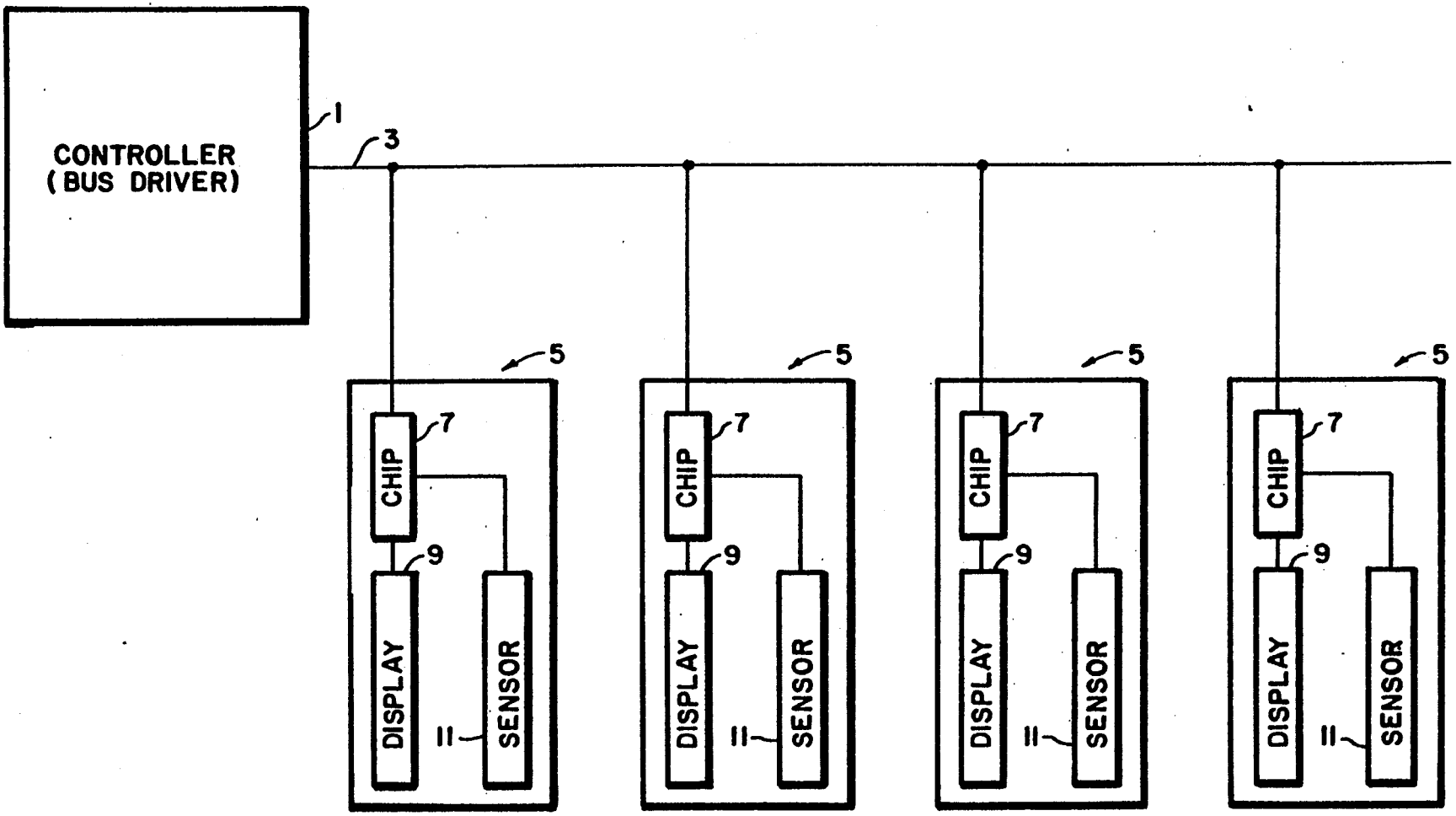
FIG. 5 is a schematic representation of the bus driver or controller coupled over a communication path to multiple transponders.

The present invention relates primarily to a communication system and method of sending broadcast messages and subsequently polling for new inputs. As shown in FIG. 5, approximately every half second, controller or input/output (IO) bus driver 10 sends out a broadcast message through communication path 3 to all transponders or modules 5. All transponders 5 which have a new input (i.e., new status input) will in turn acknowledge the broadcast message. Transponders 5 which do not have a new input will not reply to the broadcast message. Since controller 1 does not know which transponder 5 has sent the acknowledge message, it then polls each individual transponder 5 in order to find the new input data.

Communication path 3 can be a pair of electrical conductors, an optical fiber conductor, coaxial cable, air, or any other path. At least two of transponders 5 have different addresses. Controller 1 and individual transponders 5 communicate using a polling technique which incorporates time periods to allow communication between controller 1 and the selected, or addressed, transponder 5.

Each transponder 5 typically includes a microcomputer (chip) 7, which for the present invention has a latching device; display circuit 9, and sensor 11. Various types of transponders 5 may be connected to controller 1. Transponders 5, for example, are generic input modules, generic supervised output modules, generic unsupervised output modules, generic FRD (Fire Department Relay) modules, coil terminated relay modules, adder power supply modules, audio tone generators, zoned paging modules, telephone modules, master telephone modules, and loop controllers. Other forms of transponders include remote sensors such as heat or smoke detectors.

With broadcast messages (i.e., new input status searches) spaced approximately half a second apart, input response time on the IO bus typically forming path 3 of the system is relatively slow. This speed is not adequate for reliable capture of momentary inputs, such as switch closures. In order to compensate for this shortcoming, IO modules or transponders are responsible for capturing such momentary input states, and hold the new input state until it is read by the controller. A transponder 5 is preferably designed to capture any input state with a duration of 100 milliseconds or longer. It latches the first input state change, by means of the latching device forming part of chip 7, that occurs from the last time in which the transponder was individually polled by the controller for input status.

The scanning, latching and reporting of new input states by the transponder is best understood by referring to FIGS. 1, 2, 3, and 4. It should be noted that for simplicity, the examples set forth in the figures only show two state inputs (i.e., high or low). Many types of IO circuits may produce more than two input states. Each circuit on a generic input module may have four input states. The maximum number of input states per circuit supported by an IO bus is, for example, 256, when there is only one circuit on a module.

A momentary input is typically defined as an input whose duration is longer than 100 milliseconds but shorter than 0.5 seconds. A steady input is an input which last much longer than 0.5 seconds, i.e., an input which would ensure detection by the system even without input latching.

Figure 1:
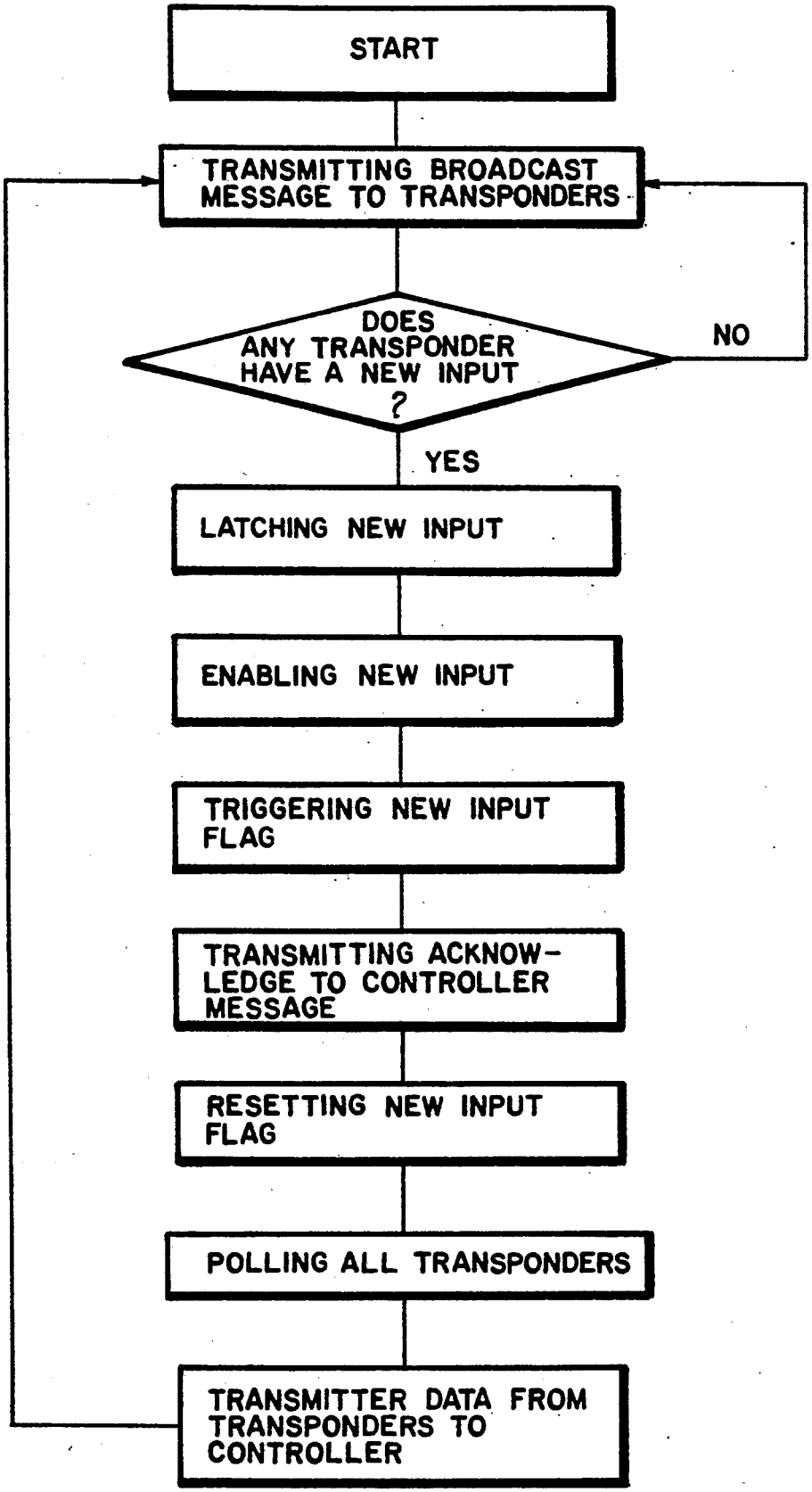
FIG. 1 is a flowchart depicting the operational steps performed by the communication system according to the present invention.

The communication system according to the present invention can best be described while referring to the operational steps recited in the flowchart of FIG. 1. Upon start-up the controller 1, e.g., an IO bus driver (FIG. 5), periodically transmits on line 3 a broadcast message to all transponders. Such broadcast messages are, as one example, transmitted approximately every 0.5 seconds. If any of the transponders receives a new input, for example, an alarm input from a sensor 11, then the transponder will latch the new input, i.e., store the first new input since the last individual polling. The transponder will not be enabled to receive any new inputs until the controller individually polls the transponder and the new input data is transmitted from the transponder to the controller.

The latching of a new input at the transponder simultaneously causes the triggering or setting of a new input flag. It is this new input flag which indicates that there is a new input state in the input latch waiting to be sent to the controller. That is, if the new input flag of any of the circuits on a transponder is triggered or set during the broadcast message, it sends an acknowledge message in response to the broadcast message. It is this acknowledge message transmitted from a transponder to the controller which causes the controller to cease the transmission of additional broadcast messages and institute an individual polling of all the transponders to determine which transponders have sent an acknowledge message and to transfer the new input data from the transponders to the controller.

The system of the present invention is arranged such that the highest priority transponders have the lowest addresses. Accordingly, when an acknowledge message is received in response to a broadcast message, the system will start polling at address zero, thereby providing fast response to important, i.e., highest priority, inputs.

Individual polling of the transponders can be accomplished by any conventional polling technique (sequential or random). Subsequent to the individual polling of all transponders connected to the system, the controller returns to the repetitive transmission of broadcast messages until another new input is received by any transponder. It is believed that utilization of broadcast messages instead of continuous individual polling for new inputs will substantially reduce energy consumption, and provide a fast response to high priority inputs.

Figure 2:
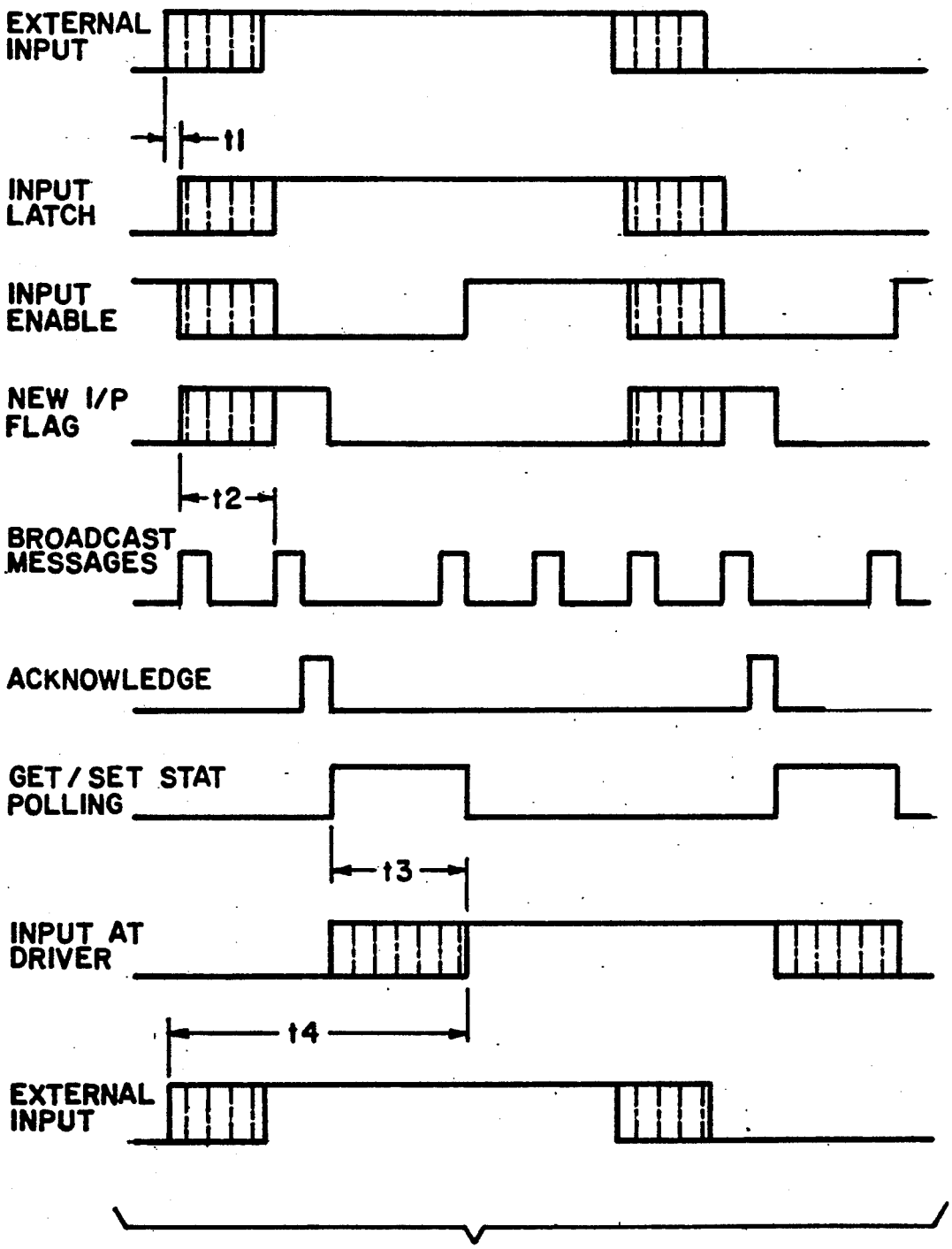
FIG. 2 is a diagram depicting the various timing signals representing the logical conditions during input scanning and status latching operation of a steady new input.

FIG. 2 diagrammatically depicts what occurs in the communication system according to the present invention on the occasion of a new steady input being presented at a transponder or IO module. The various timing signals or pulses in FIG. 2 represent logical conditions which are generated during input scanning and status latching operations. These timing signals are used to illustrate and describe the operation of the system. They do not necessarily represent actual implementation.

The timing signal designated as EXTERNAL INPUT depicts a typical new input state presented by external devices to a circuit on the IO module. The high input level is long enough for many broadcast messages to occur and for any new inputs to be acknowledged. As such, the INPUT LATCH timing signal replicates the EXTERNAL INPUT signal very closely, except that it is delayed by t1, i.e., the input debounce time.

INPUT ENABLE is an internal logical signal which indicates when input scanning is enabled and when it is disabled. Input is enabled when INPUT ENABLE pulse is high. Moreover, a new input can only be latched in INPUT LATCH if INPUT ENABLE pulse is high. The falling edges of an INPUT ENABLE signal directly follows the rising or falling edge of the INPUT LATCH signal.

The NEW I/P FLAG is set when a new input state is latched in INPUT LATCH. This flag indicates that there is a new input state in INPUT LATCH which is waiting to be sent to the controller. If the NEW I/P FLAG of any of the circuits on a module or transponder is set during the transmission of a broadcast message, the module will send an acknowledge message in response to the broadcast message. If the NEW I/P FLAG is not set then the module does not send an acknowledge message. The NEW I/P FLAG is cleared or reset after a broadcast message is received and acknowledged. The rising edge of the NEW I/P FLAG signal directly follows the rising or falling edge of the INPUT LATCH signal.

The timing signal designated BROADCAST MESSAGE indicates when broadcast messages are received. Each message is depicted as a narrow pulse. The pulse width is negligible and could be considered to be approximately zero. Only the timing of its occurrence is of concern. Broadcast messages are normally sent at 0.5 second intervals, except when individual status polls are being sent. Once the status polling is completed, another broadcast message is sent immediately.

The timing signal designated ACKNOWLEDGE corresponds to the transmission of an acknowledge message by a module in respond to a broadcast message if the NEW I/P FLAG of any of the circuits on the module are set or triggered. Immediately upon transmission of the acknowledge message from the module or transponder to the controller, an individual status polling routine is initiated. That is, if the system (i.e., IO bus driver) receives an acknowledge message during a broadcast message, the GET/SET STATUS POLLING carries out a complete input and output update with all modules. It polls each installed address with a get/set module status poll regardless of the new input status received from the modules. The time required to do a complete update is a function of the total number of modules on the bus, not module status, i.e., the controller does not terminate the polling operation once it has received a new input status even though that new input status caused the transmission of the acknowledge message in response to the prior broadcast message. The high pulse depicted in the GET/SET STATUS POLLING timing signal diagrammatically demonstrates the length of time it take to complete input and output interrogation of all the modules of the system. The controller always sends out another broadcast message immediately after a complete input and output update operation.

The timing signal designated INPUT AT DRIVER is the timing of EXTERNAL INPUT as received by the controller or IO bus driver. When the new input is a steady input, the waveform of INPUT AT DRIVER follows that of EXTERNAL INPUT signal reasonably well, i.e., the duration of the high pulse levels and low pulse levels of INPUT AT DRIVER is about the same as EXTERNAL INPUT. The major difference is that INPUT AT DRIVER is delayed by a certain length of time, as indicated by t4 on the timing diagram. The length of t4 can be determined as follows:

$$t4 = t1 + t2 + t3 \quad \text{(total input delay)}$$

wherein:

t1 = input debounce time, e.g., 100 milliseconds t2 = variable delay caused by a periodic public broadcast message. Maximum delay is 0.5 seconds. Actual delay depends on relative time of input occurrence in between broadcast messages.

t3 = variable delay caused by input search. Maximum delay is 0.8 seconds when the system is fully loaded with 128 addresses. Actual delay is a function of module address. On the basis of sequential search of all addresses, delay time is shorter for lower addresses.

Figure 3:
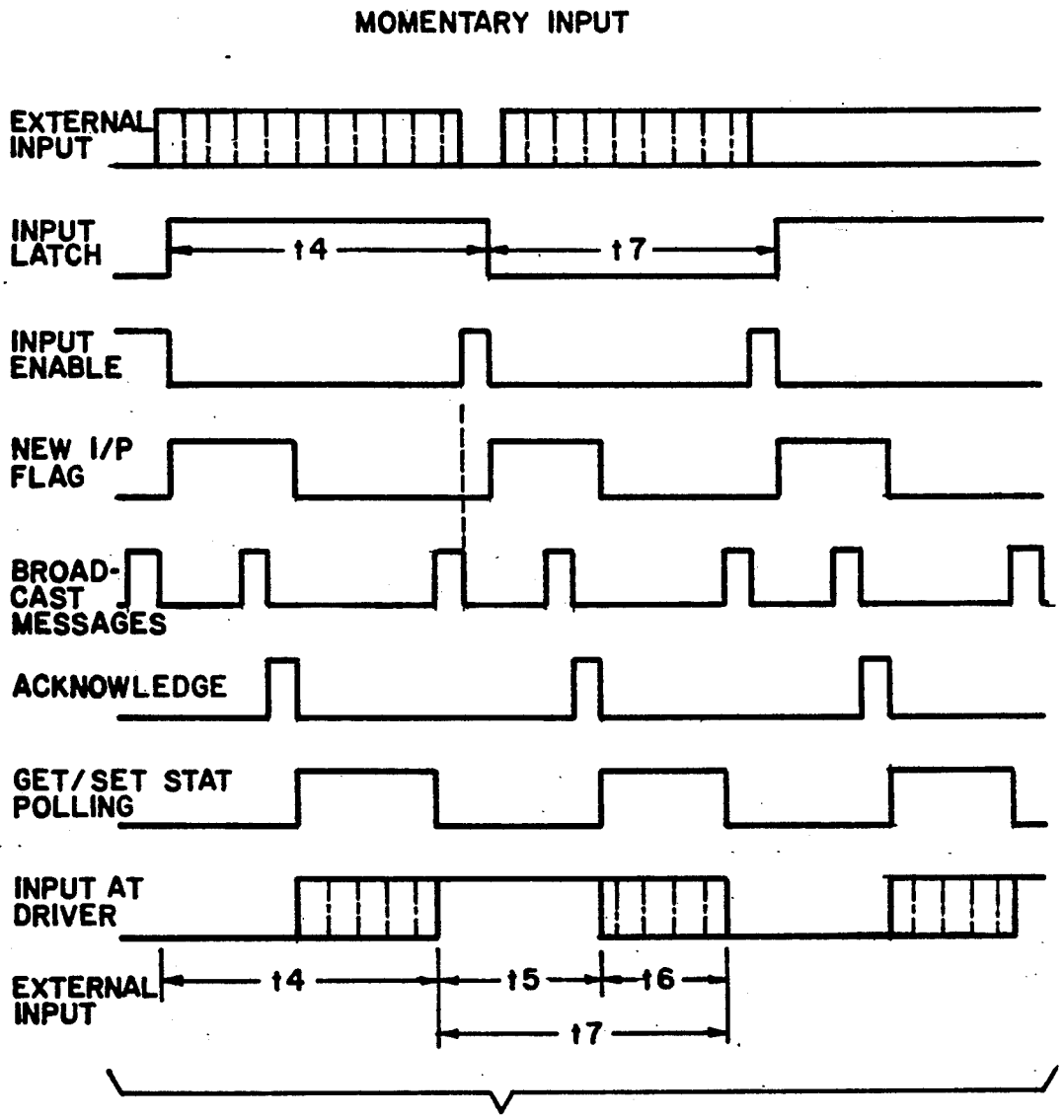
FIG. 3 is a diagram depicting the various timing signals representing the logical conditions during input scanning and status latching operation of a momentary new input.

FIG. 3 diagrammatically depicts what occurs in the communication system according to the present invention on the occasion of a new momentary input being presented at a transponder or IO module. The various timing signals or pulses in FIG. 3 represent logical conditions which are generated during input scanning and status latching operations. During a momentary input the first high level input as depicted in EXTERNAL INPUT is a very short input. The pulse width for a momentary input only needs to be wide enough to pass input debounce, e.g., 100 milliseconds or longer. The shaded area indicates the period of time when new input sampling is disabled and the module is awaiting the acknowledgment of the last input state.

New inputs can occur anywhere within the shaded area without affecting the rising edge on the INPUT LATCH. In the case of momentary inputs, there is a certain amount of distortion in the pulse width of the INPUT LATCH. While an EXTERNAL INPUT pulse could be as short as 100 milliseconds, the resulting INPUT LATCH pulse could be as much as 1.3 seconds, as indicated by t4. The value of t4 is determined in the same way as described above.

The INPUT ENABLE, NEW I/P FLAG, BROADCAST MESSAGES, ACKNOWLEDGE, and GET/SET STATUS POLLING all operate in the same fashion as that discussed during a steady input.

When EXTERNAL INPUT is a momentary input, there is a certain amount of distortion in the pulse width of INPUT AT ^C ^ CDRIVER when compared to EXTERNAL INPUT. In FIG. 3:

t4=input delay time as calculated in FIG. 2, i.e., it varies from a fraction of a second to 1.3 seconds.

t7=t5+t6 (the pulse width as received by the system) wherein:

t5=0.5 seconds, i.e., the interval between broadcast messages.

t6=a function of module address, and it varies from almost 0 for address 0 to 0.8 seconds for address 128 (assuming sequential polling).

The minimum pulse width for a momentary input varies between 0.5 seconds to 1.3 seconds. This also limits the rate of input changes which could be detected and reported. The maximum rate of input changes is 1 input change in 1.3 seconds.

Figure 4:
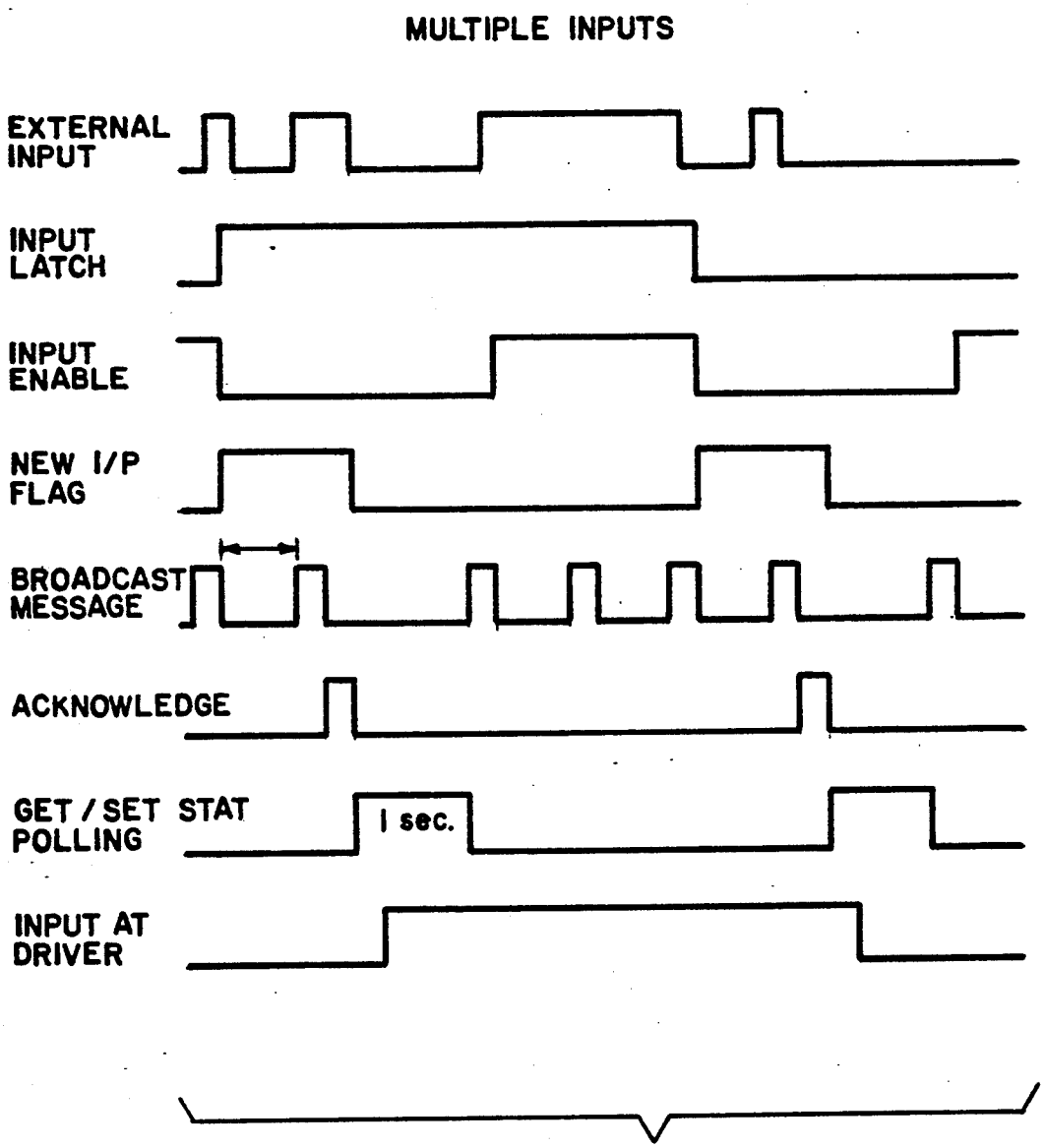
FIG. 4 is a diagram depicting the various timing signals representing the logical conditions during input scanning and status latching operation of multiple new inputs.

FIG. 4 diagrammatically depicts what occurs in the communication system according to the present invention on the occasion of new multiple inputs being presented at a transponder or IO module. The various timing signals or pulses in FIG. 4 represent logical conditions which are generated during input scanning and status latching operations.

In this FIG. 4, EXTERNAL INPUT shows a series of 4 pulses. After the first pulse is sampled and latched in INPUT LATCH, INPUT ENABLE signal goes low, i.e., input is disabled, and remains low during the second pulse on EXTERNAL INPUT. Therefore, the second pulse on EXTERNAL INPUT is not sampled or latched, and thus it is not reported to the system. When INPUT ENABLE returns to high sometimes during the third pulse, EXTERNAL INPUT is still high, as far as the module is concerned. As such, the system detects no change from the last input sample and no new input is generated. When EXTERNAL INPUT finally goes low after the third pulse, INPUT ENABLE again goes low (disabling input) and stays low for sometime. The fourth pulse on EXTERNAL INPUT is ignored. The resulting INPUT AT DRIVER is a single pulse having a period corresponding to the period from the start of the first pulse to the end of the third pulse on EXTERNAL INPUT.

While we have shown and described several embodiments in accordance with out invention, it is to clearly understood that the same are susceptible to numerous changes apparent to one skilled in the art. Therefore, we do not wish to be limited to the details shown and described but intend to show all changes and modifications which come within the scope of the appended claims.

We claim:

1. A communication system in which a controller, which provides timing, is coupled over a communication path with two or more transponders, at least two of which transponders have different addresses, said system comprising:

means for periodically transmitting a broadcast message simultaneously to all of said transponders;

means for transmitting an acknowledge message, responsive to receipt of said broadcast message, from one of said transponders; to said controller responsive to a new input existing at said one of said transponders;

means for polling said transponders by sequentially transmitting signals corresponding to their individual addresses using a polling technique which incorporates time periods to allow communication between the controller and a selected transponder, wherein said means for polling is activated to poll all of the transponders only if at least said one of the transponders has acknowledge the broadcast message by transmitting an acknowledge message to said controller; and means for polling high priority transponders first by starting the polling at address zero, said high priority transponders having addresses, which are the lowest of addresses assigned to transponders.

2. The communication system according to claim 1, wherein said controller is an input/output bus driver.

3. The communication system according to claim 1, wherein said transponders are various types of input/output modules.

4. The communication system according to claim 1, wherein said transponders are external sensors.

5. The communication system according to claim 1, wherein the communication system also includes a means for latching said new input.

6. The communication system according to claim 1, wherein the communication system also includes a means for enabling new inputs and a means for disabling new inputs.

7. The communication system according to claim 1, wherein the communication system also includes a means for triggering a new input flag and a means for resetting said new input flag.

8. The communication system according to claim 1, wherein the communication system also includes a means for resetting the timing of said controller.

* * * * *